US008043118B1

(12) United States Patent
Lee

(10) Patent No.: US 8,043,118 B1
(45) Date of Patent: Oct. 25, 2011

(54) COAXIAL CONNECTOR WITH A HOUSING WITH A CONTACT MEMBER AND A CONDUCTOR COAXIAL WITH THE HOUSING

(75) Inventor: Wen Lung Lee, Hsinchu (TW)

(73) Assignee: Microelectronics Technology Inc., Hsinchu (TW)

( * ) Notice: Subject to any disclaimer, the term of this patent is extended or adjusted under 35 U.S.C. 154(b) by 0 days.

(21) Appl. No.: 12/897,965

(22) Filed: Oct. 5, 2010

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 5,329,262 | A * | 7/1994 | Fisher, Jr. | 333/33 |
| 6,146,168 | A * | 11/2000 | Ishii | 439/188 |
| 6,699,054 | B1 * | 3/2004 | Critelli | 439/248 |
| 6,780,051 | B2 * | 8/2004 | Otsu | 439/578 |
| 7,556,529 | B2 * | 7/2009 | Wakamatsu et al. | 439/578 |

* cited by examiner

*Primary Examiner* — Chandrika Prasad
(74) *Attorney, Agent, or Firm* — WPAT, P.C.; Anthony King

(57) ABSTRACT

A radio frequency coaxial adaptor includes a housing having an end portion to engage a mating connector, a contact member mounted to the housing and moveable in a reciprocating manner relative to the housing, and a conductor coaxial with the housing and having a first end portion and a second end portion. The first end portion extends within the contact member, and the second end portion extends within the end portion of the housing for electrically engaging the mating connector.

19 Claims, 7 Drawing Sheets

COAXIAL CONNECTOR WITH A HOUSING WITH A CONTACT MEMBER AND A CONDUCTOR COAXIAL WITH THE HOUSING

BACKGROUND OF THE INVENTION

1. Field of the Invention

The present invention relates to a radio frequency adaptor.

2. Description of the Related Art

In radio frequency (RF) technology, a network analyzer is commonly used to measure network parameters of electrical networks. The network analyzer normally requires connecting means to establish connections with the electrical networks, and in some instances, board-to-board connectors are responsible for such connections.

An RF board-to-board connector includes a base board mounted with multiple measurement connectors such as coaxial connectors to achieve connections with a target board, and standard connectors for establishing connections between the board-to-board connector and the network analyzer. Circuits are generally provided on the base board for connecting the measurement connectors with the corresponding standard connectors.

The measurement connectors of the board-to-board connector, disposed with respect to the measurement points on the target board, are usually soldered on the base board. In general, if a new target board with measurement points located differently from those of a present target board is being measured, the circuits on the base board need to be rearranged, new measurement connectors need to be soldered on the new base board, and the new board-to-board connector need to be tested and qualified. As a result, the use of the board-to-board connector is inconvenient in such regards.

SUMMARY OF THE INVENTION

On aspect of the present invention is to provide a radio frequency coaxial adaptor, which can be used for measuring a target board and can directly couple to a measurement instrument.

In accordance with one embodiment of the present invention, a radio frequency coaxial adaptor comprises a housing including an end portion to engage a mating connector, a contact member mounted to the housing and moveable in a reciprocating manner relative to the housing, and a conductor coaxial with the housing, having a first end portion extending within the contact member and a second end portion extending within the end portion of the housing for electrically engaging the mating connector.

In accordance with another embodiment of the present invention, a radio frequency coaxial adaptor comprises a housing including an end wall having an opening and an end portion extending opposite the end wall, the end portion having a groove formed therearound for retaining an engaged mating connector, a contact member including a flange portion received within the housing and configured to engage with the end wall, and a contact portion extending through the opening of the housing, a spring member retained in the housing and configured to engage the contact member, and a conductor coaxial with the housing, having a first end portion extending within the contact member and a second end portion extending within the end portion of the housing for electrically contacting the engaged mating connector.

To better understand the above-described objectives, characteristics and advantages of the present invention, embodiments, with reference to the drawings, are provided for detailed explanations.

BRIEF DESCRIPTION OF THE DRAWINGS

The invention will be described according to the appended drawings in which.

DETAILED DESCRIPTION OF THE INVENTION

Figure 1:
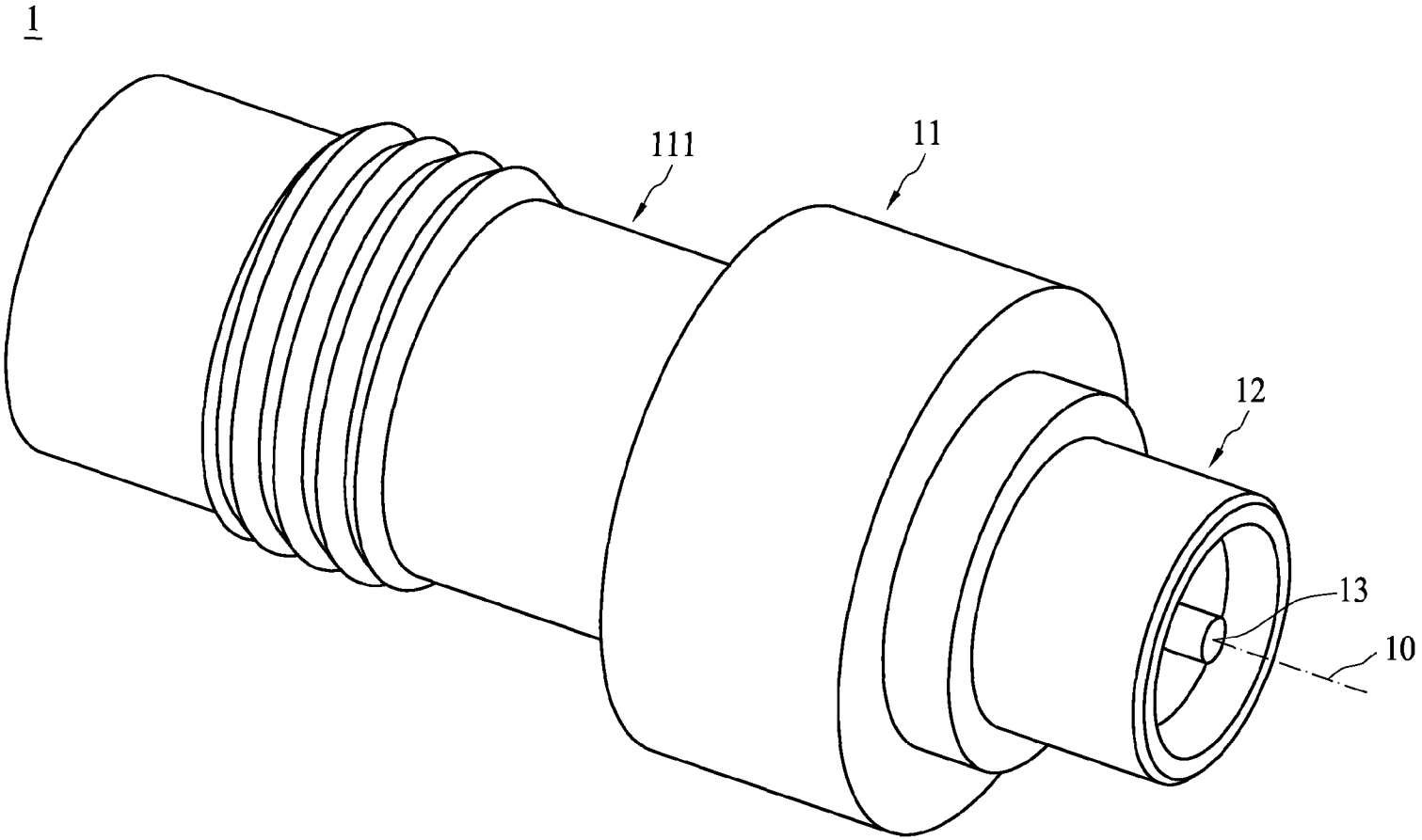
FIG. 1 is a perspective view showing a radio frequency (RF) coaxial adaptor in accordance with one embodiment of the present invention.

FIG. 1 is a perspective view showing a radio frequency (RF) coaxial adaptor 1 in accordance with one embodiment of the present invention. Referring to FIG. 1, the RF coaxial adaptor 1 comprises a housing 11 including an end portion 111 configured to engage a mating connector, a contact member 12 mounted to the housing 11 and configured to be moveable in a reciprocating manner relative to the housing, and a conductor 13 configured to be coaxial with the housing 11.

Figure 2:
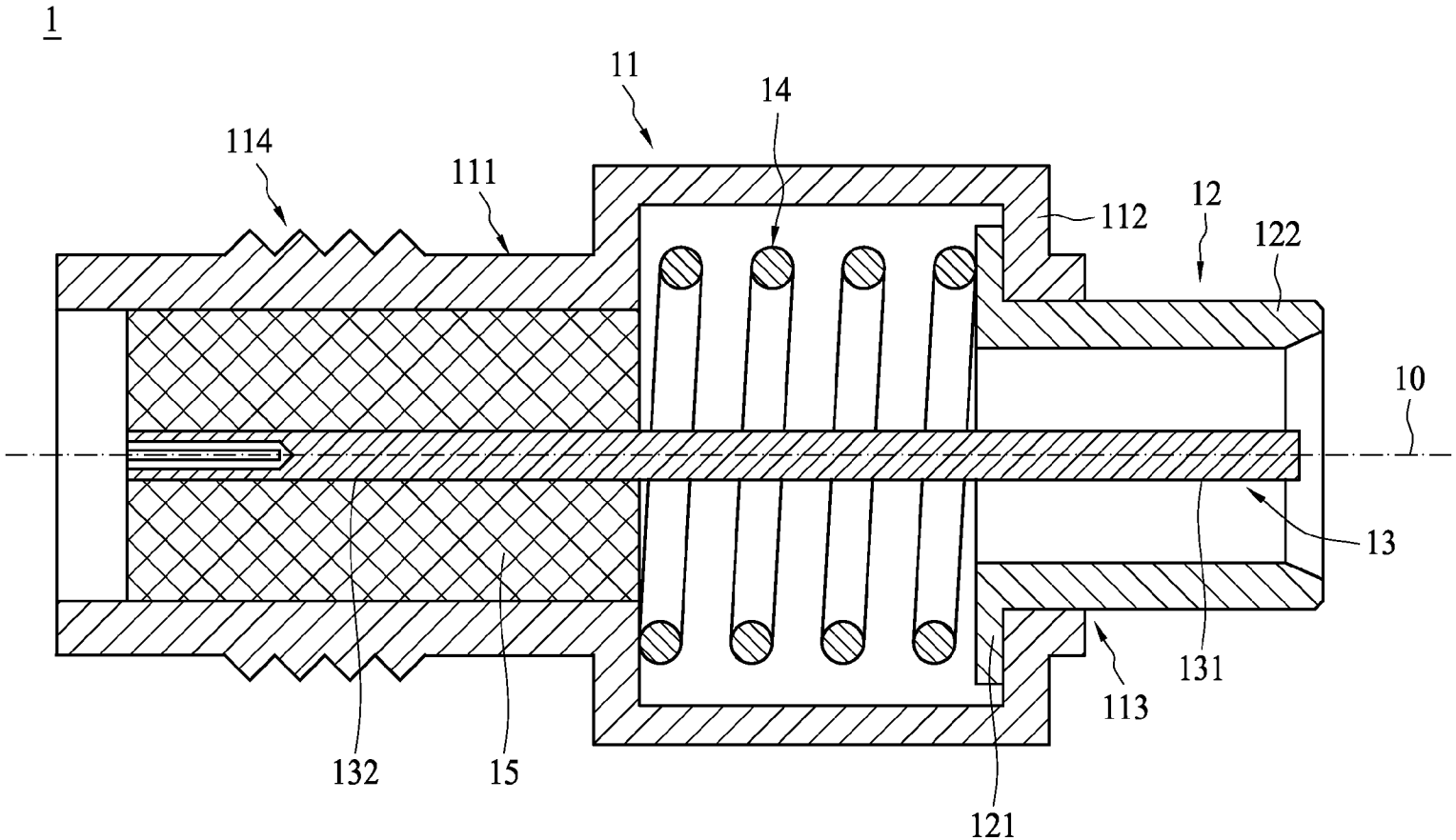
FIG. 2 is a cross-sectional view of the RF coaxial adaptor of the embodiment of FIG. 1.

FIG. 2 is a cross-sectional view of the RF coaxial adaptor 1 of the embodiment of FIG. 1. Referring to FIGS. 1 and 2, each of the housing 11 and the contact member 12 may comprise a substantially cylindrical body. That is, the housing 11 and the contact member 12 can be substantially cylindrical about a longitudinal axis 10. The conductor 13 provides a signal path through the RF coaxial adaptor 1, being coaxial with the housing 11 for providing a return path through the RF coaxial adaptor 1 so as to prevent RF leakage from the signal path. The conductor 13 includes a first end portion 131 extending within the contact member 12, and a second end portion 132 opposite to the first portion 131 and extending within the end portion 111. The second end portion 132 of the conductor 13 extends such that the conductor in an engaged mating connector may electrically engage thereto.

As illustrated in FIG. 2, the contact member 12 is mounted to the housing 11 and moveable in a reciprocating manner relative to the housing. In one embodiment of the present invention, the contact member 12 may include a flange portion 121 and a contact portion 122 extending from the flange portion 121. The housing 11 may include an end wall 112, opposite which the end portion 111 extends, including an opening 113. The flange portion 121 of the contact member 12 is, in combination, received within the housing 11 and configured to engage with the end wall 112 so that the flange portion 121 is constrained to move within the housing 11.

The contact portion 122 of the contact member 12 extends through the opening 113 toward the outside of the housing 11. The opening 113 and the contact portion 122 can also be arranged coaxially with the longitudinal axis 10 such that the contact member 12 can move along the longitudinal axis 10.

As illustrated in FIG. 2, the RF coaxial adaptor 1 may include a spring member 14. The helical spring member 14 is configured to be retained in the housing 11 and to engage the contact member 12. The flange portion 121 of the contact member 12 can be biased against the end wall 112 of the housing 11 by the compressed spring member 14.

The distal end of the first end portion 131 of the conductor 13 extends adjacent to the opening of the contact portion 122 of the contact member 12 such that when the contact portion 122 engages with a target board, the contact member 12 is depressed along the longitudinal axis 10 to allow the distal end of the first end portion 131 to establish connection with the target board. After the target board is moved away from the RF coaxial adaptor 1, the spring member 14 pushes the contact member 12 back until the flange portion 121 is against the end wall 112 of the housing 11.

Referring to FIG. 2, the end portion 111 of the housing 11 may extend opposite to the contact member 12. The end portion 111 is configured to engage a mating connector and retain the engaged mating connector by a groove 114 formed around the end portion 111. In the present embodiment, the groove 114 can be a thread formed on an outer peripheral surface of the end portion 111 as shown in FIG. 2. In another embodiment, the groove 114 can be formed on an inner peripheral surface of the end portion 111 as shown in FIG. 3.

Figure 3:
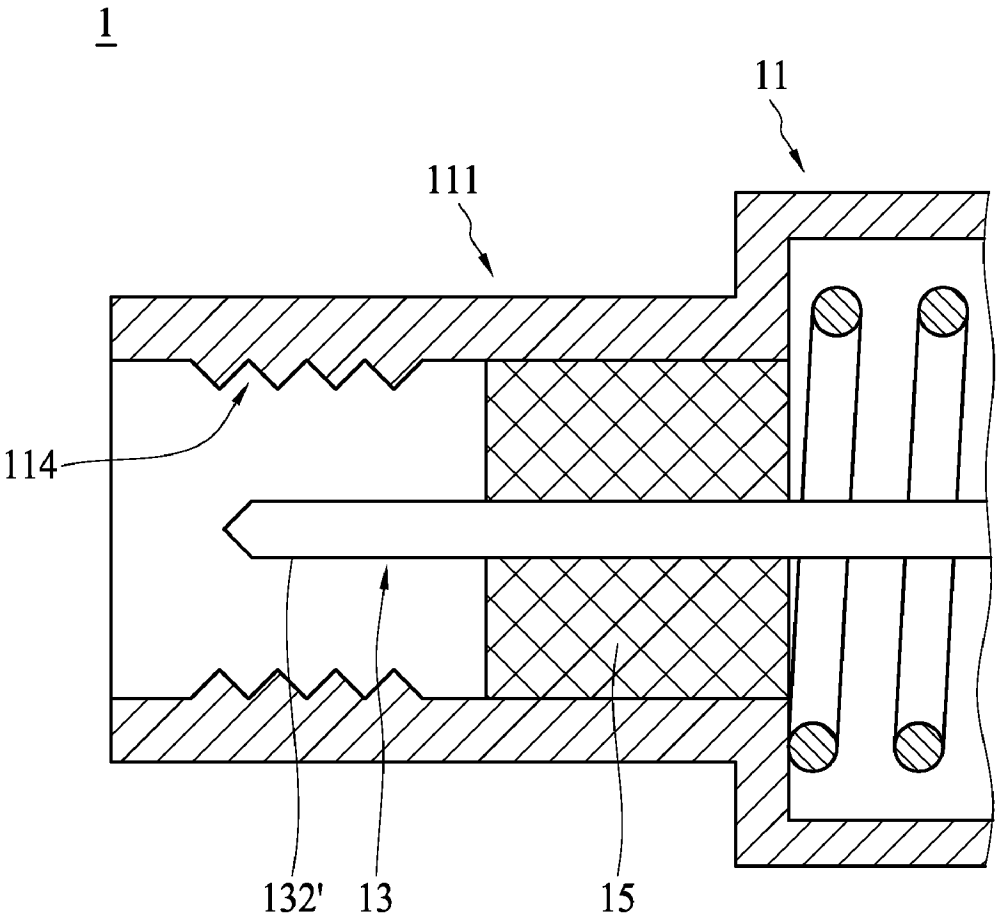
FIG. 3 illustrates a conductor with a male end portion according to one embodiment of the present invention.

Referring to FIGS. 2 and 3, the second portion 132 or 132' of the conductor 13 is configured to mate with the conductor in an engaged mating connector. In one embodiment, the second end portion 132 may be a female end portion as shown in FIG. 2. In another embodiment, the second end portion 132' may be a male end portion as shown in FIG. 3.

The end portion 111 of the housing 11 can be configured such that it can engage a standard coaxial connector such as a subminiature type A connector.

Referring to FIG. 2 again, the conductor 13 can be held stationary within the housing 11 and dielectrically isolated from the housing 11 by a dielectric member 15. The dielectric member 15 can be substantially cylindrical about the longitudinal axis 10 as well, having an aperture, through which the conductor 13 extends, formed along the longitudinal axis 10.

Figure 4:
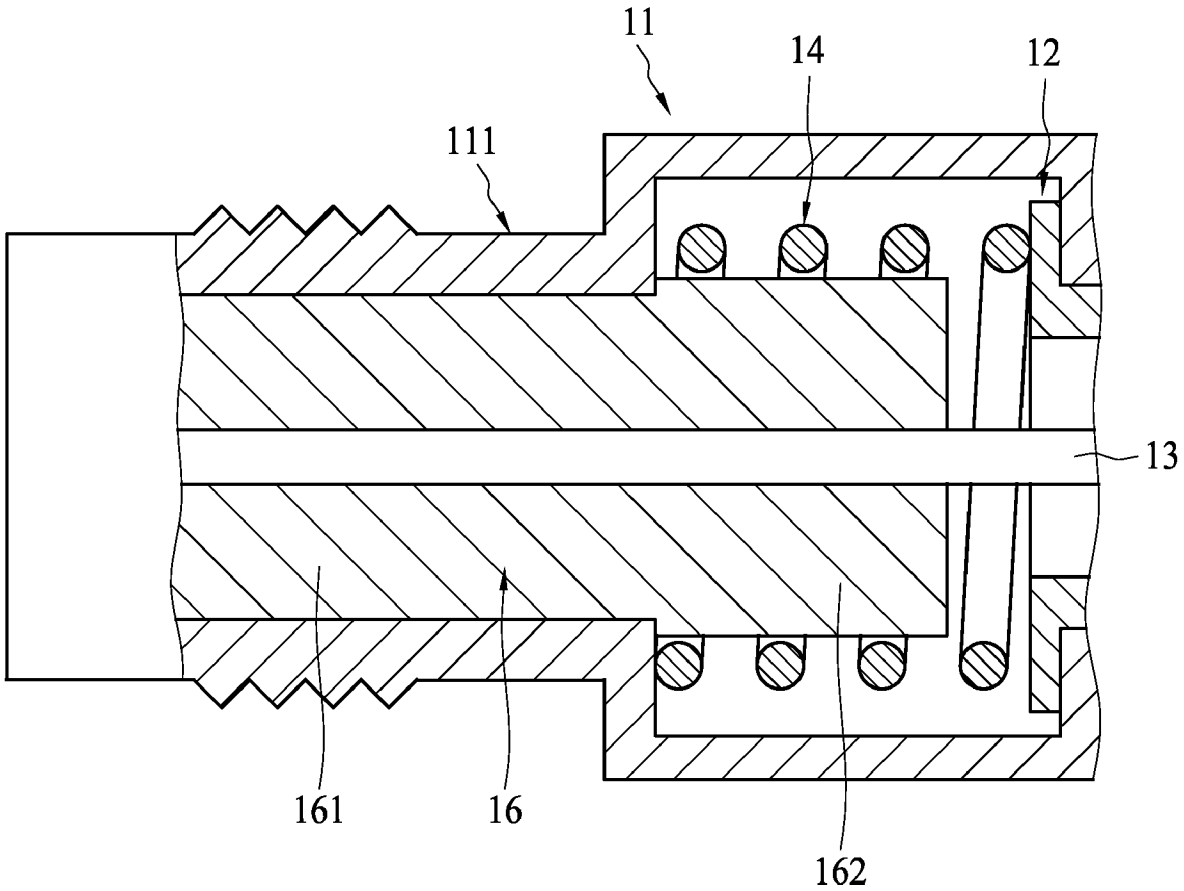
FIG. 4 illustrates a dielectric member according to another embodiment of the present invention.

As shown in FIG. 4, in another embodiment, an alternative dielectric member 16 can be provided. The dielectric member 16 includes a first portion 161 received within the end portion 111 of the housing 11 and a second portion 162 surrounded by the spring member 14. The second portion 162 can extend along the longitudinal axis 10 in such a manner that if the contact member 12 is depressed against the second portion 162, the conductor 13 protrudes beyond the opening of the contact member 12 with a length in a range of from 0.5 to 1 millimeter. The depressed contact member 12 rests against the dielectric member 16 can prevent the depressed contact member 12 from tilting.

Figure 5:
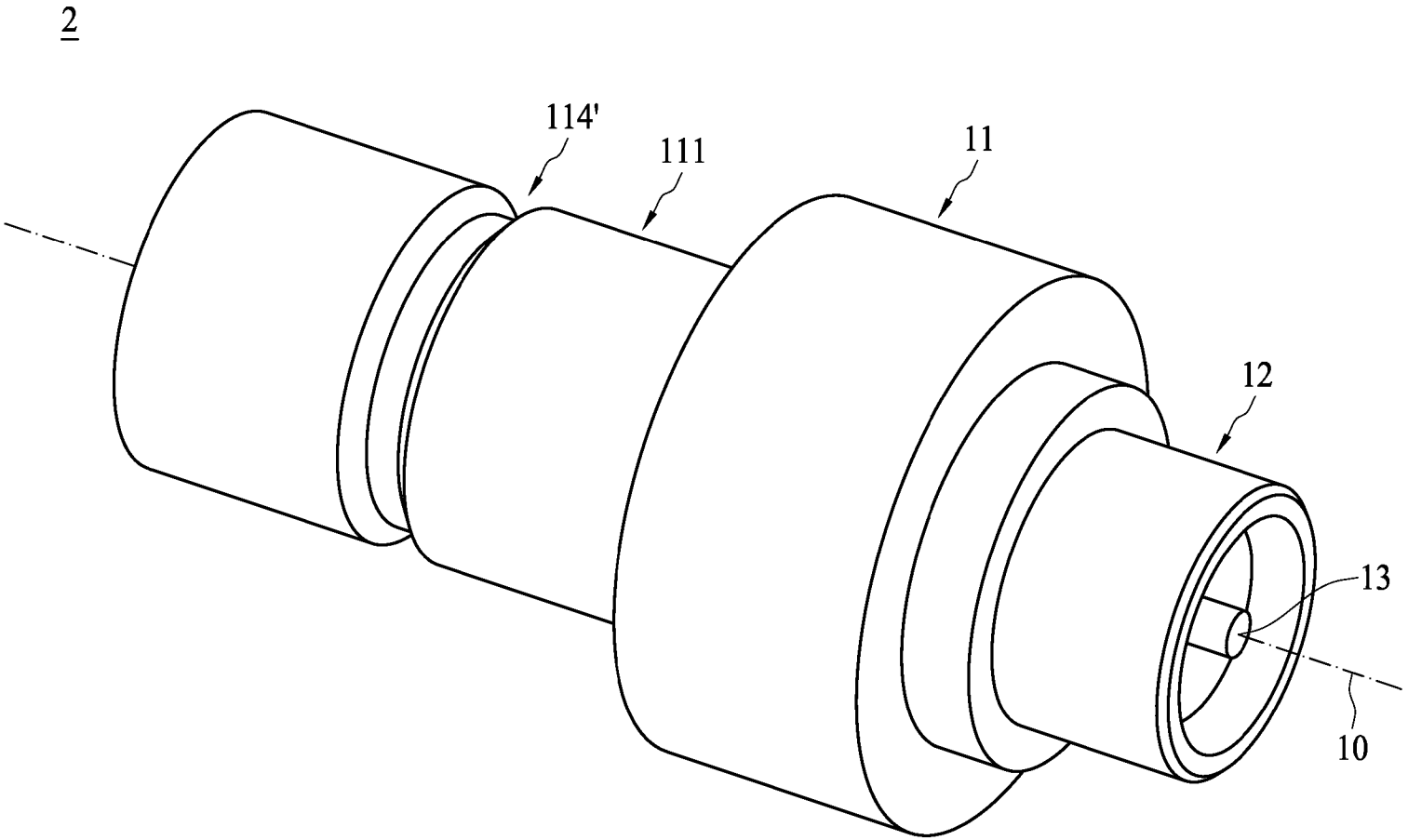
FIG. 5 is a perspective view showing an RF coaxial adaptor in accordance with another embodiment of the present invention.
Figure 6:
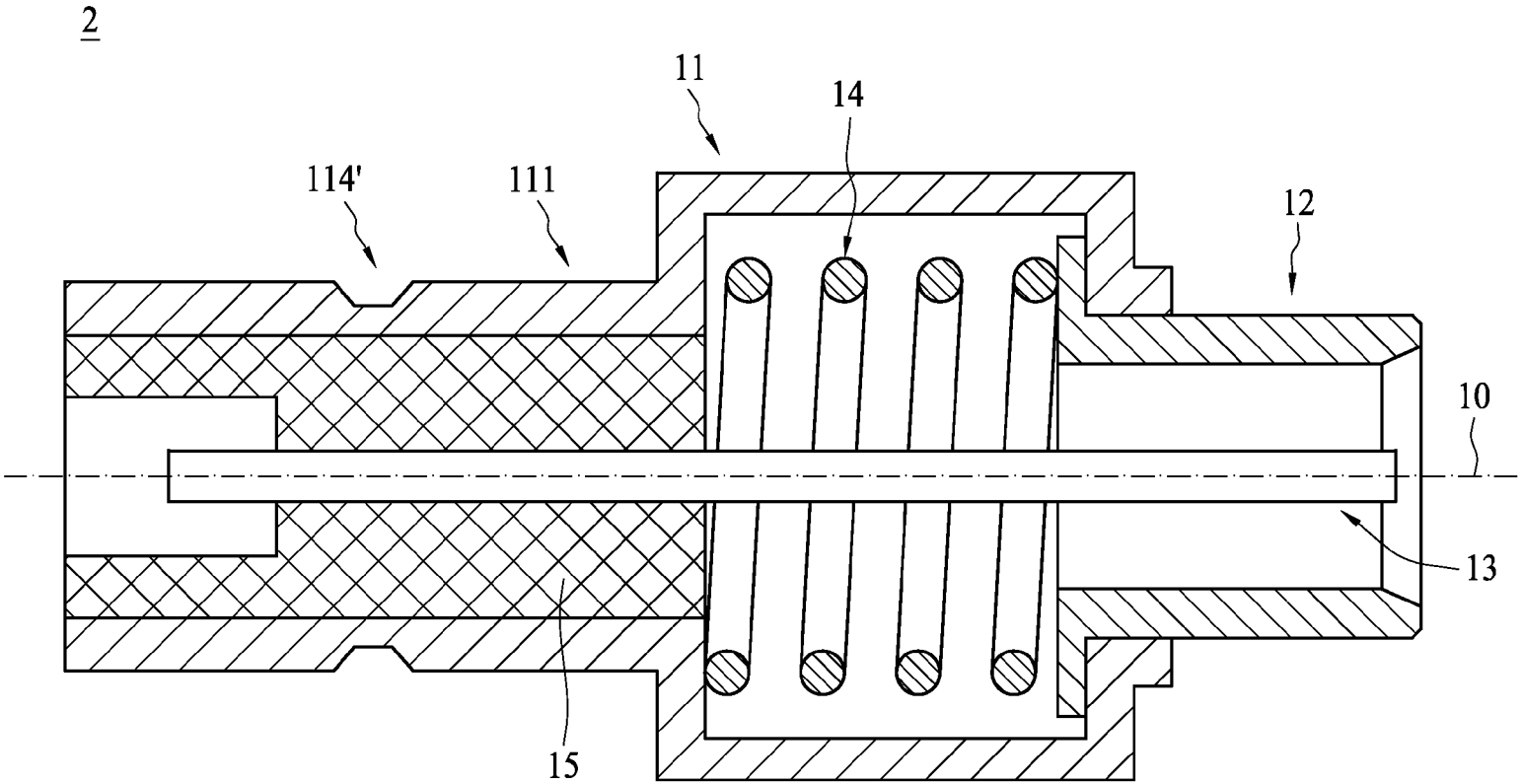
FIG. 6 is a cross-sectional view of the RF coaxial adaptor of the embodiment of FIG. 5.

Referring to FIGS. 5 and 6, another embodiment of the present invention discloses an RF coaxial adaptor 2, which includes a housing 11 having an end portion 111 extending opposite a contact member 12 moveable in a reciprocating manner relative to the housing 11, configured for engaging a mating connector, and on which a groove 114' is formed for snap-on coupling with the mating connector. The housing 11 and the contact member 12 can be substantially cylindrical about an axis 10. The conductor 13 can be coaxial with the housing 11 and held stationary by a dielectric member 15, which may be received in the end portion 111 of the housing 11 or may have a portion surrounded by the spring member 14 operatively engaging the contact member 12 to allow the contact member 12 to move in a reciprocating manner. In one embodiment, the end portion 111 of the housing 11 can be configured to couple with a subminiature type B connector.

Figure 7:
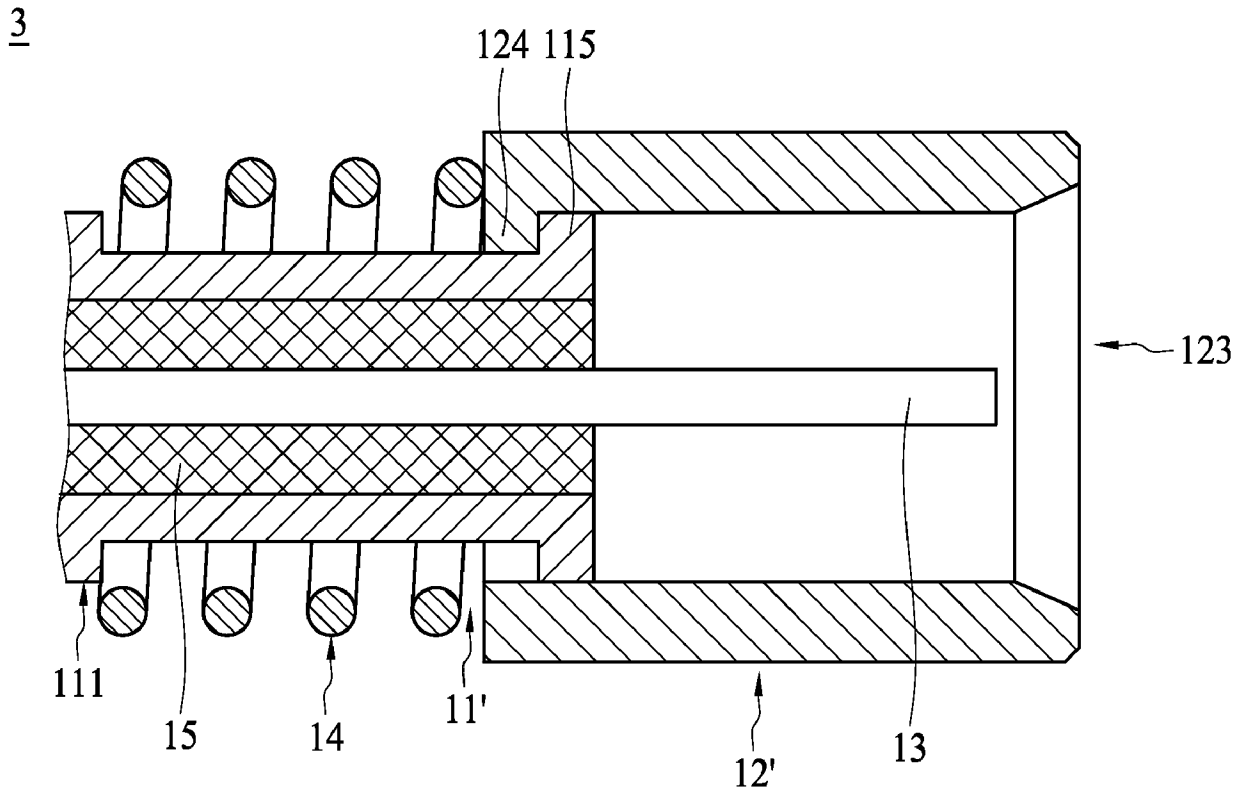
FIG. 7 is a cross-sectional view showing another exemplary RF coaxial adaptor.

FIG. 7 is a perspective view showing another radio frequency (RF) coaxial adaptor 3 in accordance with one embodiment of the present invention. The RF coaxial adaptor 3 may include a housing 11' having an end portion 111 configured to engage a standard connector such as a subminiature type A connector or a subminiature type B connector and a flange portion 115 configured to engage the end wall 124 of a contact member 12' to prevent the separation of the contact member 12' from the housing 11'. A spring member 14 surrounds the housing 11' and biased against the contact member 12' such that the contact member 12' can move in a reciprocating manner to allow the conductor 13 to establish electrical connection with a target board.

In summary, the RF coaxial adaptor includes a contact member, in which a portion of a conductor extends. When the contact member engages a target board, the contact member is depressible to allow the conductor to establish electrical connection with the target board. The RF coaxial adaptor further includes an end portion configured to engage a standard connector such that the RF coaxial adaptor can directly couple to a measurement instrument such as a network analyzer. The RF coaxial adaptor can be used independently, or multiple RF coaxial adaptors can be simultaneously used. Because RF coaxial adaptors can directly couple to a measurement instrument, a circuit board and circuits formed on the circuit board need not be prepared.

The above-described embodiments of the present invention are intended to be illustrative only. Numerous alternative embodiments may be devised by persons skilled in the art without departing from the scope of the following claims.

What is claimed is:

1. A radio frequency coaxial adaptor, comprising:

a housing including an end portion to engage a mating connector;

a contact member mounted to the housing and moveable in a reciprocating manner relative to the housing; and a straightforward conductor coaxial with the housing, having a first end portion extending within the contact member and a second end portion extending within the end portion of the housing for electrically engaging the mating connector, wherein the first end portion is collimatedly connected to the second end portion.

2. The radio frequency coaxial adaptor of claim 1, wherein the end portion extends opposite to the contact member.

3. The radio frequency coaxial adaptor of claim 1, wherein the contact member is depressible against a spring member retained within or surrounding the housing.

4. The radio frequency coaxial adaptor of claim 1, wherein the second end portion is a male end portion or female end portion.

5. The radio frequency coaxial adaptor of claim 1, wherein the end portion of the housing includes a groove formed therearound for retaining the mating connector.

6. The radio frequency coaxial adaptor of claim 5, wherein the groove comprises a thread formed on an outer peripheral surface or an inner peripheral surface of the end portion of the housing.

7. The radio frequency coaxial adaptor of claim 5, wherein the groove is configured for snap-on coupling.

8. The radio frequency coaxial adaptor of claim 1, wherein the mating connector is a subminiature type A connector or a subminiature type B connector.

9. The radio frequency coaxial adaptor of claim 1, wherein each of the housing and the contact member comprises a substantially cylindrical body.

10. The radio frequency coaxial adaptor of claim 1, wherein the conductor extends through a dielectric member retained in the end portion of the housing.

11. A radio frequency coaxial adaptor, comprising:

a housing including an end wall having an opening and an end portion extending opposite the end wall, the end portion having a groove formed therearound for retaining an engaged mating connector;

a contact member including a flange portion received within the housing and configured to engage with the end wall, and a contact portion extending through the opening of the housing;

a spring member retained in the housing and configured to engage the contact member; and a straightforward conductor coaxial with the housing, having a first end portion extending within the contact member and a second end portion extending within the end portion of the housing for electrically contacting the engaged mating connector, wherein the first end portion is collimatedly connected to the second end portion, and the straightforward conductor penetrates through the spring member.

12. The radio frequency coaxial adaptor of claim 11, wherein the second end portion is a male end portion or female end portion.

13. The radio frequency coaxial adaptor of claim 11, wherein the groove comprises a thread formed on an outer peripheral surface or an inner peripheral surface of the end portion.

14. The radio frequency coaxial adaptor of claim 11, wherein the groove is configured for snap-on coupling.

15. The radio frequency coaxial adaptor of claim 11, wherein the engaged mating connector is a subminiature type A connector or a subminiature type B connector.

16. The radio frequency coaxial adaptor of claim 11, wherein each of the housing and the contact member comprises a substantially cylindrical body.

17. The radio frequency coaxial adaptor of claim 11, wherein the spring member directly engages the flange portion of the contact member.

18. The radio frequency coaxial adaptor of claim 11, wherein the conductor extends through a dielectric member retained in the end portion of the housing.

19. The radio frequency coaxial adaptor of claim 18, wherein the dielectric member includes a first portion within the end portion of the housing and a second portion surrounded by the spring member, wherein the second portion of the dielectric member is configured such that if the contact member is depressed against the second portion of the dielectric member, the conductor protrudes beyond an opening of the contact member with a length of from 0.5 to 1 millimeter.

* * * * *